US009506668B2

(12) United States Patent
Sinur et al.

(10) Patent No.: US 9,506,668 B2
(45) Date of Patent: Nov. 29, 2016

(54) MAKE-UP AIR SYSTEM AND METHOD

(75) Inventors: Richard R. Sinur, Grafton, WI (US); Tom P. Haidel, Neosho, WI (US); Brian R. Wellnitz, Grafton, WI (US)

(73) Assignee: Broan-NuTone LLC, Hartford, WI (US)

( * ) Notice: Subject to any disclaimer, the term of this patent is extended or adjusted under 35 U.S.C. 154(b) by 851 days.

(21) Appl. No.: 13/352,155

(22) Filed: Jan. 17, 2012

(65) Prior Publication Data

US 2012/0282853 A1 Nov. 8, 2012

Related U.S. Application Data

(60) Provisional application No. 61/482,068, filed on May 3, 2011.

(51) Int. Cl.

| | |
|---|---|
| ***F24F 11/00*** | (2006.01) |
| ***F24F 13/14*** | (2006.01) |
| ***F24F 11/04*** | (2006.01) |

(52) U.S. Cl.

CPC ..... *F24F 13/1426* (2013.01); *F24F 11/04* (2013.01); *F24F 2011/0042* (2013.01)

(58) Field of Classification Search

CPC ..... F24F 13/1426; F24F 11/04; F24F 2011/0042

USPC ..... 454/237, 238

See application file for complete search history.

(56) References Cited

U.S. PATENT DOCUMENTS 4,266,528 A * 5/1981 Barnhart ..... F24C 15/20 126/299 D
RE31,112 E * 12/1982 Prikkel, III ..... 236/1 G
4,498,624 A * 2/1985 Kogut ..... 237/53
4,773,311 A * 9/1988 Sharp ..... B08B 15/023 454/239
4,784,114 A * 11/1988 Muckler et al. ..... 126/299 E
4,995,307 A * 2/1991 Floyd ..... F24F 3/044 454/255
5,131,887 A * 7/1992 Traudt ..... E04B 1/0023 454/236
5,205,783 A * 4/1993 Dieckert et al. ..... 454/238
5,362,273 A * 11/1994 Pfeiffer et al. ..... 454/63
RE35,199 E * 4/1996 Gervais ..... F04D 27/00 137/486
5,720,658 A * 2/1998 Belusa ..... 454/238
5,764,579 A * 6/1998 McMasters et al. ..... 700/2
5,820,456 A * 10/1998 Nelson ..... 454/52
6,170,480 B1 * 1/2001 Melink ..... F24C 15/2021 126/299 D
6,283,851 B1 * 9/2001 Smith ..... F24F 11/0076 454/239
6,358,137 B1 * 3/2002 Threlfall ..... 454/61
6,364,211 B1 * 4/2002 Saleh ..... 236/49.3
6,634,939 B2 * 10/2003 Johnson ..... 454/238
6,669,547 B2 * 12/2003 Liu ..... 454/61
6,779,735 B1 * 8/2004 Onstott ..... 236/13

(Continued)

*Primary Examiner* — Steven B McAllister
*Assistant Examiner* — Jonathan Cotov
(74) *Attorney, Agent, or Firm* — Schwegman Lundberg & Woessner, P.A.

(57) ABSTRACT

Embodiments of the invention provide a system capable of reducing negative pressure. The system includes a make-up air system that can be configured and arranged to be installed within a structure, such as a building. The system can also include a pressure switch that is configured and arranged to sense a pressure within an exhaust duct coupled to an exhaust device. The pressure switch can also be configured to communicate an activation signal and a deactivation signal to the make-up air system. In some embodiments, communication of the activation and deactivation signals can be at least partially dependent on the pressure within the exhaust duct. Moreover, the pressure switch can be configured and arranged to be retroactively coupled to at least one of the exhaust duct and the exhaust device.

23 Claims, 11 Drawing Sheets

(56) References Cited

U.S. PATENT DOCUMENTS

| | | | | |
|---|---|---|---|---|
| 6,890,252 | B2 * | 5/2005 | Liu | 454/61 |
| 6,981,915 | B2 * | 1/2006 | Moore | F24F 11/053 137/553 |
| 7,001,263 | B2 * | 2/2006 | Shaben | 454/67 |
| 7,216,495 | B1 * | 5/2007 | Harrison | 62/115 |
| 7,275,533 | B2 * | 10/2007 | Soeholm et al. | 126/299 R |
| 7,494,524 | B1 * | 2/2009 | Lehmann, Jr. | B01D 46/0028 454/238 |
| 7,601,054 | B2 * | 10/2009 | Bagwell et al. | 454/49 |
| 7,963,830 | B2 * | 6/2011 | Luddy et al. | 454/49 |
| 8,038,515 | B2 * | 10/2011 | Livchak et al. | 454/67 |
| 8,100,746 | B2 * | 1/2012 | Heidel et al. | 454/356 |
| 8,147,301 | B2 * | 4/2012 | Ghattas | 454/187 |
| 8,444,462 | B2 * | 5/2013 | Livchak et al. | 454/67 |
| 8,597,092 | B2 * | 12/2013 | Kupferberg et al. | 454/244 |
| 2003/0207662 | A1 * | 11/2003 | Liu | 454/61 |
| 2004/0020304 | A1 * | 2/2004 | Roesler | G01L 13/06 73/736 |
| 2004/0020485 | A1 * | 2/2004 | Roesler et al. | 126/80 |
| 2007/0026786 | A1 * | 2/2007 | Liu | 454/61 |
| 2007/0068509 | A1 * | 3/2007 | Bagwell et al. | 126/299 D |
| 2007/0167126 | A1 * | 7/2007 | Ghattas | F24F 3/161 454/187 |
| 2007/0204640 | A1 * | 9/2007 | Harrison | 62/241 |
| 2007/0205294 | A1 * | 9/2007 | Byczynski et al. | 236/44 C |
| 2007/0207724 | A1 * | 9/2007 | Coogan | 454/238 |
| 2008/0135041 | A1 * | 6/2008 | Robison | 126/299 D |
| 2008/0184991 | A1 * | 8/2008 | Krupp | 126/99 R |
| 2008/0233860 | A1 * | 9/2008 | Perry | 454/238 |
| 2009/0047894 | A1 * | 2/2009 | Coogan | 454/238 |
| 2009/0191493 | A1 * | 7/2009 | Guzorek | 431/12 |
| 2010/0294259 | A1 * | 11/2010 | Livchak et al. | 126/299 D |
| 2011/0053488 | A1 * | 3/2011 | Gans et al. | 454/343 |
| 2011/0212010 | A1 * | 9/2011 | Bell | 423/245.3 |
| 2013/0072102 | A1 * | 3/2013 | Trant | 454/237 |
| 2013/0180700 | A1 * | 7/2013 | Aycock | 165/248 |

* cited by examiner

MAKE-UP AIR SYSTEM AND METHOD

RELATED APPLICATIONS

This application claims priority under 35 U.S.C. §119 to U.S. Provisional Patent Application No. 61/482,068 filed on May 3, 2011, the entire contents of which is incorporated herein by reference.

BACKGROUND

As dwellings, commercial buildings, and other structures become less permeable to environmental air, air pressure differentials can arise. Some of these structures can include air flow systems, including ventilation systems, so that a portion of the air within the structure can be exhausted to the outside environment. In some structures, at least partially depending on the inclusion of a make-up air system and the rate at which air exits the structure, negative pressure can be generated within the structure. Negatively pressurized structures can experience exhaust gas inflow and some increases in potentially harmful compounds.

SUMMARY

Some embodiments of the invention provide a system capable of reducing negative pressure. In some embodiments, the system can include a make-up air system that can be configured and arranged to be installed within a structure. In some embodiments, the system can include a pressure switch that can be configured and arranged to sense a pressure within an exhaust duct coupled to an exhaust device. In some embodiments, the pressure switch can also be configured and arranged to communicate at least one of an activation signal and a deactivation signal to the make-up air system. In some embodiments, communication of the activation or deactivation signal can at least partially depend on the pressure within the exhaust duct. In some embodiments, the pressure switch can be configured and arranged to be retroactively coupled to one of the exhaust duct and the exhaust device.

Some embodiments of the invention provide a system capable of reducing negative pressure. In some embodiments, the system can include a make-up air system that can include a duct housing and a damper operatively coupled to a motor. In some embodiments, the damper can be movable between a first position and a second position. The make-up air system can be capable of being installed through a portion of a structure to fluidly connect an internal environment of the structure and an external environment of the structure when the damper is substantially disposed in the second position. In some embodiments, the system can comprise one or more switches that can be configured and arranged to communicate at least one of an activation signal and a deactivation signal to the make-up air system. In some embodiments, the switch can be configured and arranged to be retroactively coupled to one of an exhaust duct and an exhaust device.

DETAILED DESCRIPTION

Figure 1:
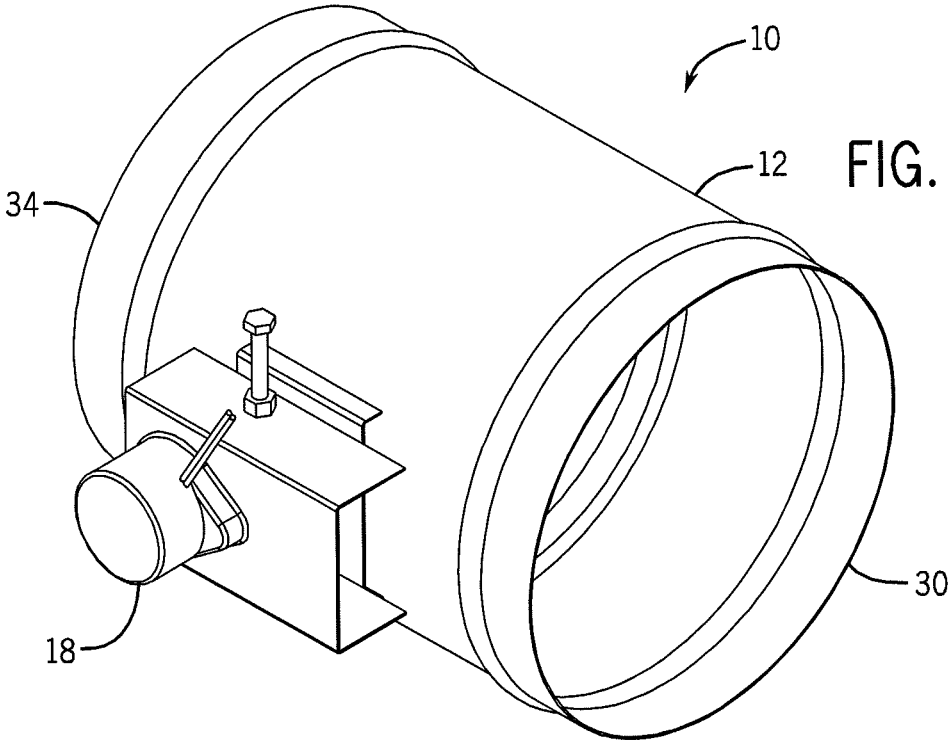
FIG. 1 is a perspective view of a make-up air system according to one embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives that fall within the scope of embodiments of the invention.

Figure 2:
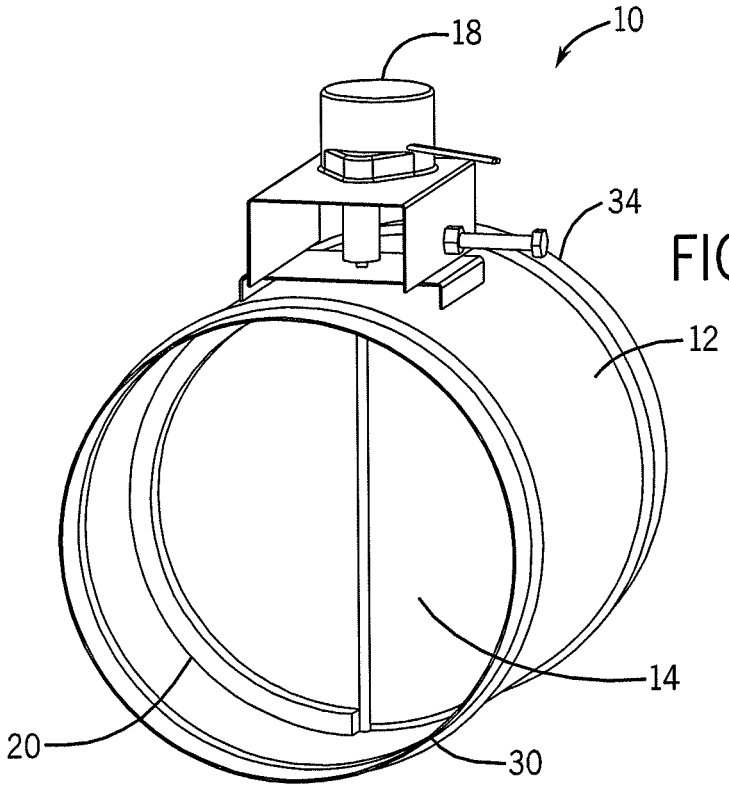
FIG. 2 is a perspective view of a make-up air system according to one embodiment of the invention.

FIGS. 1 and 2 illustrate a make-up air system 10 according to one embodiment of the invention. The system 10 can include a duct housing 12, one or more dampers 14, a motor 18, and a seal element 20. In some embodiments, portions of the system 10 can comprise a generally circular cross-section, although in other embodiments, the cross-section of the system 10 can comprise other shapes such as, but not limited to square, rectangular, regular or irregular polygonal, or other shapes.

In some embodiments, the damper 14 can be positioned substantially within the duct housing 12. Also, in some embodiments, the make-up air system 10 can include a transformer 10 or similar structure that can modulate the voltage of an electrical current. In some embodiments, the damper 14 can be operatively coupled to the motor 18 so that upon receiving a signal, the motor 18 can move the damper 14. In some embodiments, the motor 18 can rotate the damper 14 about an axis (e.g., a horizontal axis), although in other embodiments, the motor 18 can move the damper 14 in other manners, such as sliding, translating, or other single or compound forms of movement. Further, in some embodiments, the damper 14 can move about a horizontal axis, a vertical axis, or other axes between a vertical and a horizontal axis. For example, the motor 18 can rotate the damper 14 about a vertical axis so that environments on one or more sides of the damper 14 are in fluid communication with each other.

Further, in some embodiments, the motor 18 can move the damper 14 from a first position to a second position upon receiving a signal. In some embodiments, the first position can comprise a substantially closed position so that no fluids (e.g., air, gas, or other fluids) in material amounts can pass through the duct housing 12 (i.e., the duct housing 12 is substantially sealed). In some embodiments, the second position can comprise a substantially open position so that fluids can pass through the duct housing 12 and environments on both sides of the damper 14 are in fluid communication with each other. In some embodiments, the second position can be about ninety degrees away from the first position, although in other embodiments, the second position can be positioned at other angles relative to the first position. Further, in some embodiments, the motor 18 can move the damper 14 to other positions (e.g., other angles relative to the first position including from about 1 degree to about 360 degrees).

In some embodiments, the seal element 20 can be positioned within the duct housing 12. In some embodiments, the seal element 20 can be positioned within the duct housing 12 so that when the damper 14 is in the first position, the seal element 20 can contact the damper 14 to aid in preventing any material amounts of a fluid or other materials (e.g., debris) from moving through the duct housing 12. In some embodiments, the seal element 20 can comprise rubber, a polymeric material, a fibrous material, or other similar materials and can be configured and arranged to comprise a substantially similar shape relative to the damper 14.

In some embodiments, the system 10 can be installed into, and/or comprise a portion of, an exhaust device 22 in structures 24 including dwellings, commercial buildings, and other structures that can employ ventilation systems. By way of example only, some exhaust devices 22 installed in structures 24 can include apparatuses that can exhaust fluids (e.g., air, smoke, effluents, such as cooking effluent, or any other fluids) from inside of the structure 24. For example, some exhaust devices 22 can include range hoods, exhaust fans positioned in different locations throughout structures 24, fume hoods, and other air-moving or other fluid-moving apparatuses. In some embodiments, the exhaust devices 22 can comprise and/or can be coupled to a duct system 23 that can at least partially provide an avenue for air or other fluids moving through some or all portions of the structure 24. The duct system 23 can fluidly connect an outside environment with the exhaust devices 22 and/or can fluidly connect multiple rooms or areas of the structure 24. In some embodiments, the duct housing 12 can comprise a portion of the duct system 23. For example, the duct housing 12 can be coupled to the duct system 23 so that fluids, such as air, can pass through the duct housing 12, if the damper 14 is in the first position. In some embodiments, the duct housing 12 can be substantially or wholly integral with the duct system 23 and, in other embodiments, the duct housing 12 can be a separate element relative to the duct system 23.

Depending on the operational capabilities of the exhaust devices 22, relatively large amounts of air or other fluids can be exhausted from the structure 24. For example, some exhaust devices 22 can exhaust more than 300 cubic feet per minute (CFM) of air from the structure 24, although some exhaust devices 22 can exhaust air at either a greater or lesser rate than 300 CFM. Further, some structures 24 can be relatively impermeable to outside fluids, such as air. Although the relative impermeability of some structures 24 can result in relatively less natural fluid exchange between the inside and outside of the structure 24, it can result in a more-efficient structure (e.g., potentially lower energy consumption to maintain a desired internal temperature of the structure 24). For some structures, the combination of an exhaust device 22 and relative impermeability can at least partially create negative pressure during operation of one or more exhaust devices 22. The creation of negative pressure can lead to a "back draft" of potentially noxious and/or harmful outputs from some combustion appliances such as water heaters, stoves, fireplaces, and other similar appliances designed to vent to the outside environment. As a result of the potentially hazardous and/or harmful consequences of negative pressure, at least some municipalities, states, counties, and/or other jurisdictions and non-governmental entities are mandating that at least some structures 24 with exhaust devices 22 with exhaust rates over a predetermined value (e.g., greater than 300 CFM) include systems to prevent or reduce negative pressure.

Figure 3:
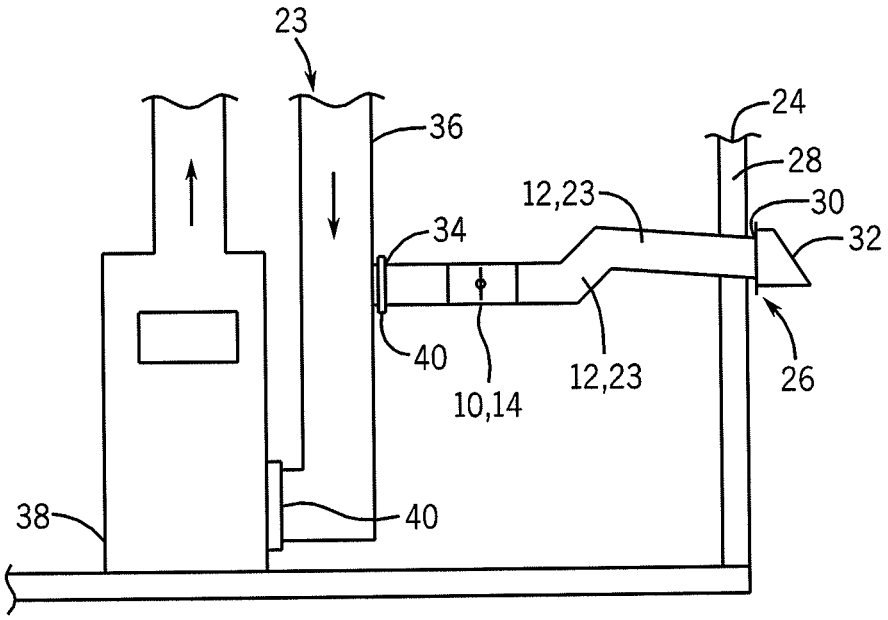
FIG. 3 is a diagram of a make-up air system installed in a structure according to one embodiment of the invention.
Figure 4:
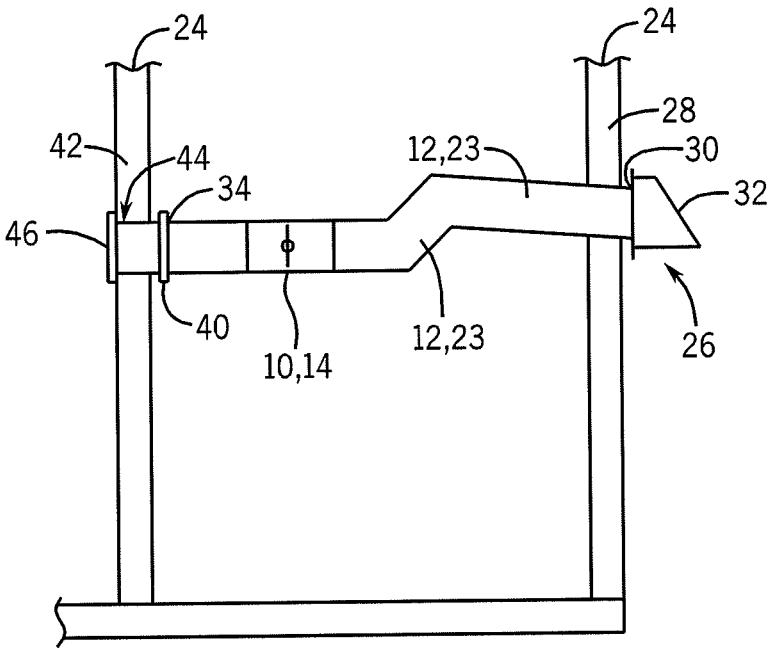
FIG. 4 is a diagram of a make-up air system installed in a structure according to one embodiment of the invention.

As shown in FIGS. 3 and 4, in some embodiments, the system 10 can be installed within one or more structures 24. For example, in some embodiments, the structure 24 can include an aperture 26 through a portion of an outer wall 28 and a first end 30 of the duct housing 12 can be positioned immediately adjacent to and/or through the aperture 26 so that portions of the duct housing 12 can be in fluid communication with the outside environment. In some embodiments, a cap 32 can be coupled to the outside wall 28 adjacent to the aperture 26 to at least partially shield the aperture 26 from environmental conditions (e.g., precipitation, dust, debris, etc.).

In some embodiments, a second end 34 of the duct housing 12 can be coupled to other portions of the structure 24. In some embodiments, the second end 34 of the duct housing 12 can be operatively coupled to at least a portion the duct system 23, such as an air return duct 36 so that the duct housing 12 can be in fluid communication with the air return duct 36. For example, as show in FIG. 3, the duct system 23 of the structure 24 can comprise the air return duct 36 that is in fluid communication with portions of the structure 24. In some embodiments, as air or other fluids move through the duct system 23 (e.g., for heating, ventilating, air cooling, exhausting air, and/or other purposes), a portion of the air within the structure can be circulated through an air handler unit 38 via the air return duct 36 from portions of the structure 24. As a result, when the damper 14 is in the second position (i.e., in a generally open position), a fluid, such as air, can enter the duct system 23. In addition, in some embodiments, at least some of the air circulating through the air return duct 36 can enter into the structure 24. Further, in some embodiments, a filter 40 can be positioned between the second end 34 of the duct housing 12 and the air return duct 36 to at least partially filter any fluids passing through the duct housing 12 before entering the air return duct 36.

Further, as shown in FIG. 4, in some embodiments, the duct housing 12 can be positioned so that it is in fluid communication with a room or other area and/or region of the structure 24. In some embodiments, the duct housing 12 can substantially extend from the outer wall 28 to and/or through an interior wall 42. For example, in some embodiments, the interior wall 42 can comprise an aperture 44 into which the second end 34 of the duct housing 12 can extend. Further, in some embodiments, the interior wall 42 can comprise a register 46 operatively coupled to the wall 42 and the second end 34 so that any air or other fluids circulating through the duct housing 12 can at least partially flow through the register 46 before entering the room. Further, in some embodiments, a filter 40 can be positioned substantially between the second end 34 of the duct housing 12 and the interior wall 42 to at least partially filter any fluids passing through the duct housing 12 before entering the room. As a result, regardless of installation location, upon the motor 18 moving the damper 14, a portion of a fluid, such as air, can flow from the environment outside of the structure 24 to the inside of the structure 24, which, in some embodiments, can at least partially reduce and/or eliminate some or all of the negative pressure within the structure 24.

Figure 5:
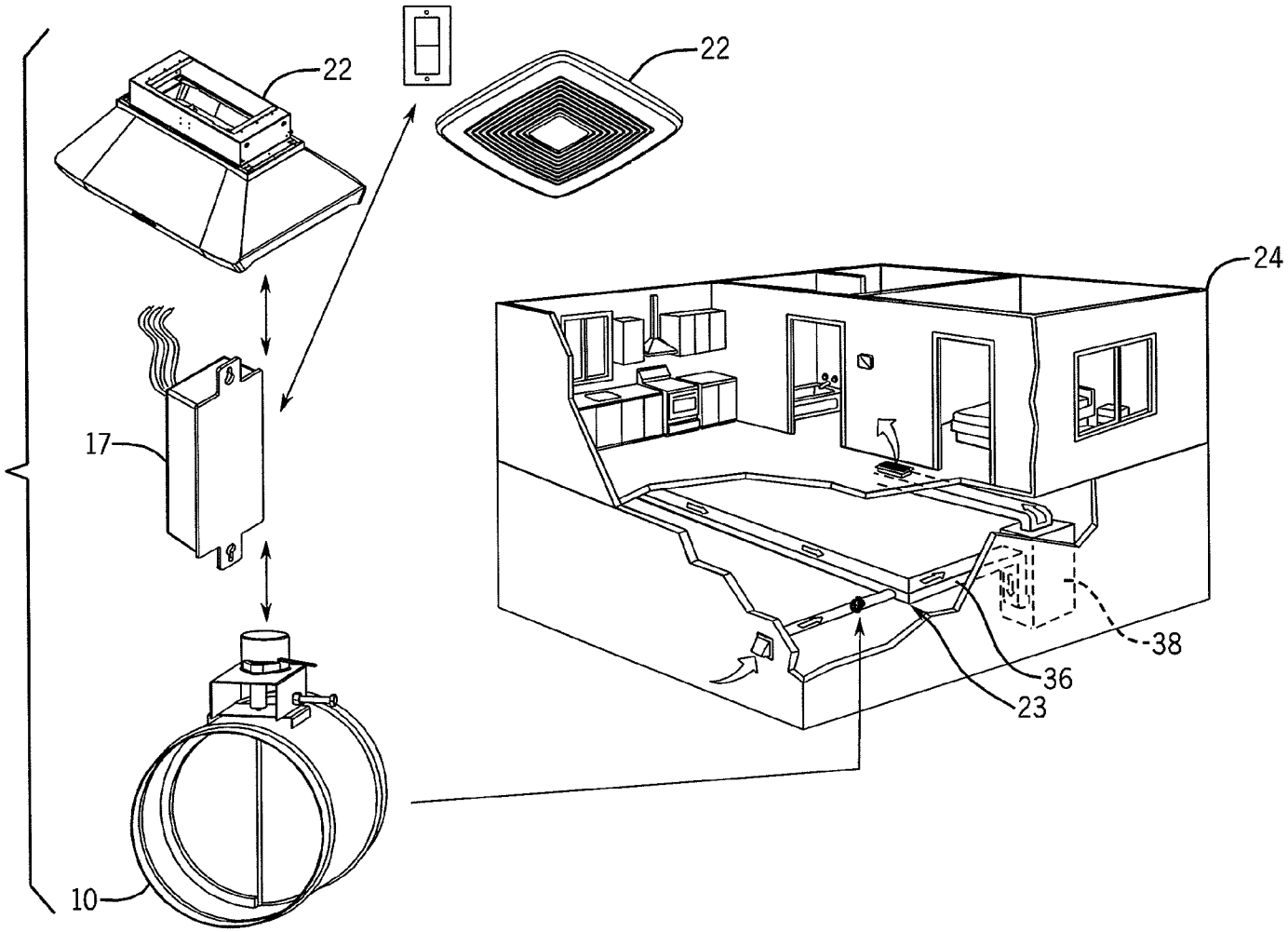
FIG. 5 is a diagram of a make-up air system installed in a structure according to one embodiment of the invention.

In some embodiments, the motor 18 can receive one or more signals to move the damper 14. In some embodiments, the signal can originate from different locations. For example, in some embodiments, the structure 24 can further comprise a control module 17 (e.g., a digital and/or analog control module) operatively coupled to an electrical network of the structure 24, as shown in FIG. 5. In some embodiments, the control module 17 can send, receive, and/or process communication protocols that can enable transmission of a signal from one device to another. Wired and/or wireless communication can be used for such signal transmissions. For example, in some embodiments, the control module 17 can comprise Insteon™ and/or LinkLogic™ protocols. In some embodiments, by activating the exhaust apparatus 22, a signal can be relayed through the electrical network via the control module 17 to activate the motor 18 to move the damper 14. Accordingly, by activating the exhaust device 22, the system 10 also can be activated to move the damper 14 and allow air to enter the structure 24 to substantially reduce and/or substantially prevent the build up of negative pressure within the structure 24.

Moreover, in some embodiments, a signal also can be transmitted from an exhaust device 22 to the motor 18 via a dry contact relay to lead to movement of the damper 14. Also, in some embodiments, multiple systems can be installed into a structure 24 so that multiple dampers 14 can be present, to meet any structure occupants' needs and requirements. Moreover, in some embodiments, structures 24 can comprise multiple exhaust devices 22 and each device 22 can signal a different make-up air system 10 to operate a damper 14. For example, the structure 24 can comprise an in-structure network so that activation of a first exhaust device 22 in a first zone or region of the structure 24 can activate a damper 14 to enable influx of air or other fluids in the first zone or region of the structure 24. Moreover, larger structures 24 can comprise a plurality of zone or regions and a plurality of corresponding make-up air systems 10 so that individual zones can be networked with one or more make-up air systems 10 to reduce and/or eliminate negative pressure within one or more zones or regions.

In some embodiments, by deactivating the exhaust device 22, a deactivation signal can be transmitted to the system 10 to return the damper 14 to the first position and substantially seal the duct housing 12. In some embodiments, the damper 14 can remain open for a pre-determined period of time after deactivation of the exhaust device 22, and then can return to the first position (i.e., movement of the damper 14 can be at least partially controlled based on passage of time since receiving an activation signal).

In some embodiments, the system 10 can be substantially and/or completely passive. For example, in some embodiments, the system 10 can function effectively without a motor 18 and/or other electrical components. In some embodiments, after activation of one or more exhaust devices 22, some negative pressure can develop within the structure 24. In some embodiments, however, the damper 14 can be configured and arranged so that when the negative pressure reaches a pre-determined threshold, a differential in pressure between the inside and the outside of the structure 24 can cause the damper 14 to move, which can allow air into the structure 24 to reduce the negative pressure. Also, in some embodiments comprising a motor 18, the damper 14 can be configured so that, in the event of a failure of the motor 18 and/or other electrical components, by default the damper 14 can open as a result of a differential in pressure between the inside and the outside of the structure 24 to reduce negative pressure.

In some embodiments, some or all of the activation and/or deactivation signals discussed above and below can be coupled to (e.g., installed) existing exhaust devices 22 and/or existing duct systems 23 within structures 24 (e.g., some or all of the activation apparatuses can be "retro-fit" onto existing elements of the structure 24). For example, some structures 22 that require a make-up air system 10 (e.g., a structure 22 including one or more exhaust devices 22 and configured to be relatively impermeable to air or other fluids from the outside environment) may currently be functioning without the system 10. Moreover, it may be necessary for a user to install one or more make-up air systems 10 into the structure 22 to reduce or eliminate any possible negative pressure build-up. Accordingly, in some embodiments of the invention, some or all of the activation apparatuses that transmit activation signals can be installed within structures 24 (e.g., exhaust devices 22, duct systems 23, etc.) after all or partial completion of the structure 24 and prior installation of one or more exhaust devices 22.

As described in the following paragraphs, one or more activation apparatuses can be coupled to the duct systems 23, exhaust devices 22, or other elements of some structures 24 to retroactively provide a make-up air system 10 for pre-existing ventilating and other fluid-movement configurations. Moreover, although the following paragraphs describe retroactively installing the make-up air systems 10 and their activation apparatuses, some or all of embodiments can be installed during initial construction of the structure 24 and the duct system 23, and/or installation of the exhaust device 22. Additionally, although FIGS. 7-12 depict the exhaust device 22 as an apparatus substantially similar to a conventional range hood, the make-up air system 10 can be used in connection with operations of clothing dryers, vented water heaters, fireplace fans, and any other appliance or apparatus that vents exhaust.

Figure 7A:
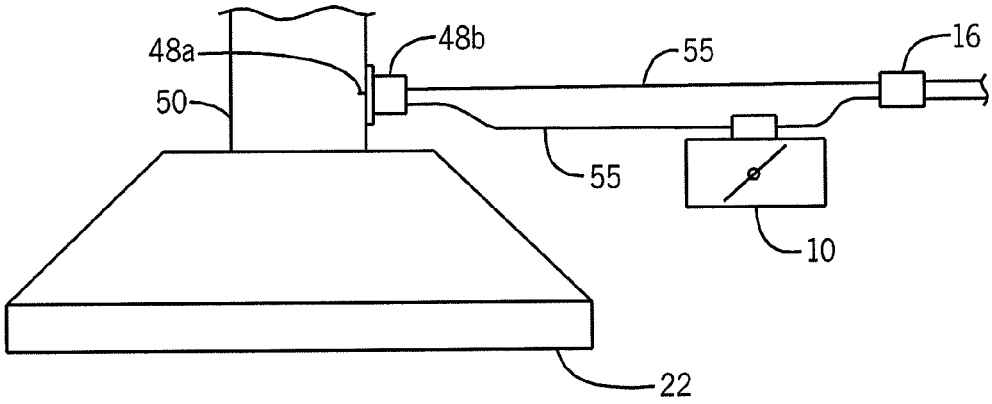
FIGS. 7A-7C are diagrams of a pressure switch retroactively coupled to an exhaust device according to one embodiment of the invention.
Figure 7B:
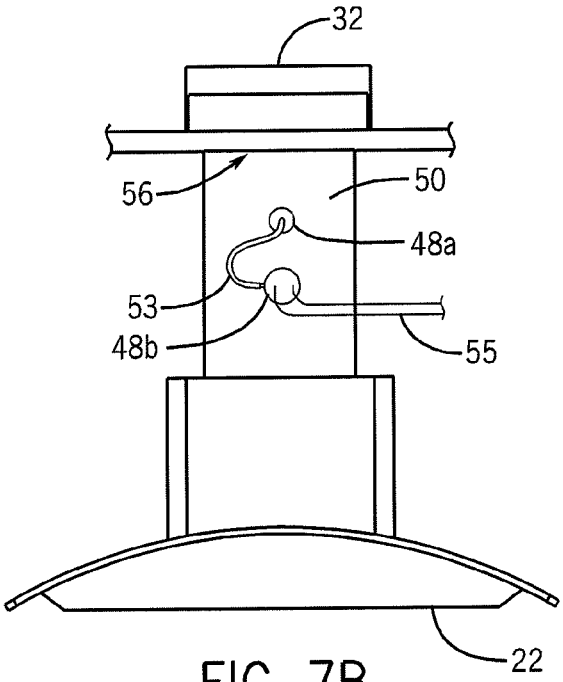

As shown in FIG. 7A, in some embodiments, one or more switches 48 can be coupled to the duct system 23 to provide an activation signal to the motor 18 to move the damper 14. In some embodiments, the switch 48 can comprise a pressure switch 48 (i.e., the switch 48 can be configured and arranged to detect changes in pressure). As shown in FIGS. 7A and 7B, an exhaust device 22 can be coupled to an exhaust duct 50 that can be in fluid communication with the outside environment or other portions of the duct system 23 to provide an avenue for exhausted fluid (e.g., air, cooking effluent, etc.) to exit the structure 24.

In some embodiments, one or more switches 48 can be coupled to the exhaust duct 50 so that at least a portion of the switch 48 can be in fluid communication with an interior of the exhaust duct 50. For example, as shown in FIG. 7B, the switch 48 can comprise one or more probes 48*a* and one or more switch modules 48*b*. In some embodiments, the switch module 48*b* can be coupled to an exterior of the exhaust duct 50 and the one or more probes 48*a* can be at least partially inserted through the exhaust duct 50 so that the probe 48*a* is in fluid communication with the interior of the exhaust duct 50. Moreover, the probe 48*a* can be in communication with the switch module 48*b* via a hose 53 coupled an inlet 54 of the module 48*b*, so that the probe 48*a* can relay the pressure present within the exhaust duct 50 to the module 48*b* so that the module 48*b* can assess the pressure level. As a result of being coupled to the exhaust duct 50 in this or a similar position, the probe 48*a* conveys changes in pressure within the exhaust duct 50 to the switch module 48*b* which can process the pressure values to assess whether the make-up air system 10 should be activated or deactivated.

Figure 6:
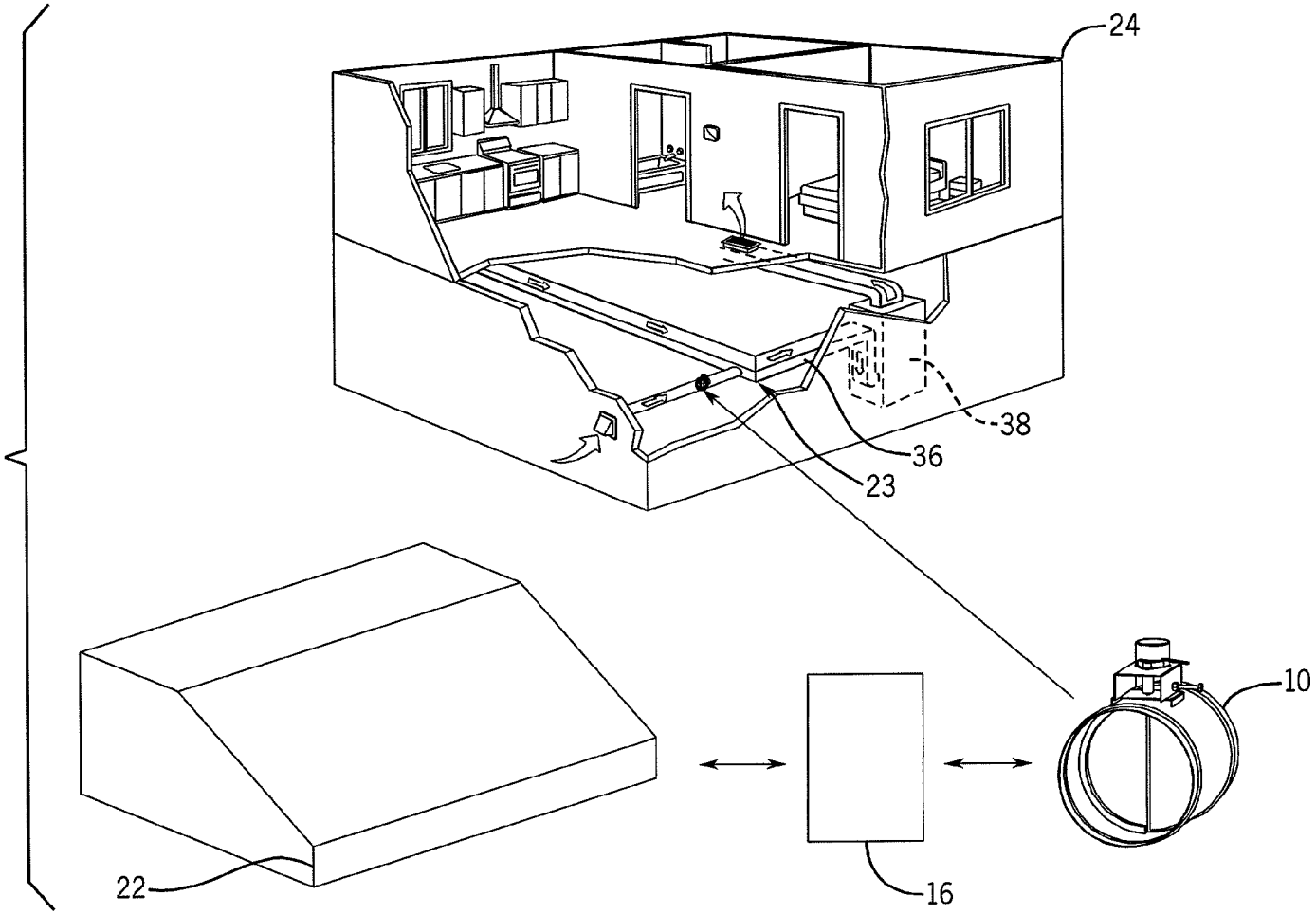
FIG. 6 is a diagram of a make-up air system installed in a structure according to one embodiment of the invention.
Figure 7C:
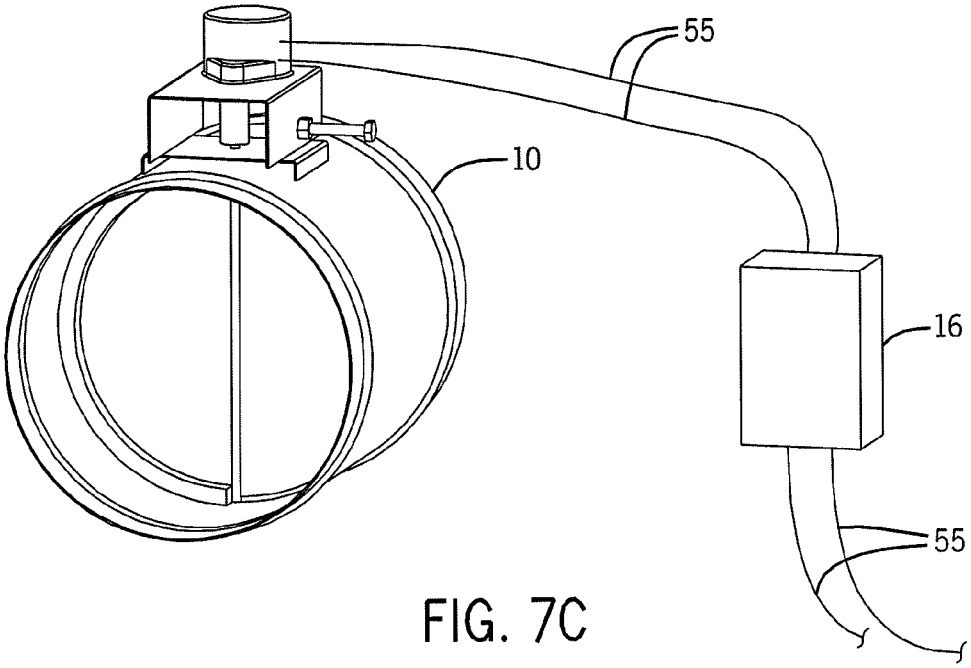

In some embodiments, the switch module 48*b* can be in electrical communication with one or more make-up air systems 10. As shown in FIGS. 7A-7C, one or more electrical lines 55 can connect the make-up air system 10 and the switch module 48*b*. As previously mentioned and shown in FIGS. 5 and 6, in some embodiments, the make-up air system 10 can be in fluid communication with the outside environment through one or more outer walls 28. As a result, the make-up air system 10 need not be substantially adjacent to the switch 48 (e.g., the electrical lines 55 can extend a small or great distance through the structure 24 to where the system 10 is positioned), although, the make-up air system 10 can be substantially adjacent to the switch 48. Furthermore, in some embodiments, the switch module 48*b* can communicate with the motor 18 in other manners. For example, in some embodiments, the switch module 48*b* can be wirelessly connected to a conventional controller for the motor 18 (e.g., via radio-frequency transmission) to transmit the activation signal.

In some embodiments, upon detecting a change in pressure within the exhaust duct 50 via the probe 48*a*, the switch module 48*b* can provide a current (e.g., a low voltage current, such as a 24 Volt current), via the electrical lines 55, to the motor 18 to move the damper 14. For example, in some embodiments, activation of the exhaust device 22 can trigger air flow through the exhaust duct 50 (e.g., air or other fluids moving toward the outside environment), and, as a result of the probe 48*a* being in fluid communication with the interior of the exhaust duct 50, the probe 48*a* can convey pressure changes within the exhaust duct 50 arising from air flow through the duct 50. In some embodiments, after assessing the duct 50 pressure from the probe 48*a*, the switch module 48*b* can activate the motor 18 to move the damper 14 to enable air from the outside environment to enter the structure 24 to reduce or eliminate any negative pressure accumulation. Moreover, in some embodiments, after the switch module 48*b* fails to detect sufficient pressure within the exhaust duct 50, the switch 48 can open so that current ceases flowing to the make-up air system 10 to closer the damper 14.

In some embodiments, the switch 48 can be configured and arranged ensure activation of the make-up air system 10 at appropriate times. As previously mentioned, the make-up air system 10 can be used to reduce or eliminate negative pressure that can result from a great volume of air being exhausted from the structure 24 (e.g., greater than or equal to about 300 CFM). Accordingly, it could be unnecessary to activate the make-up air system 10 when exhaust devices 22 exhaust air from the structure 24 at a lesser rate. In some embodiments, the switch 48 can be configured and arranged so that the switch module 48*b* does not activate the make-up air system 10 unless the probe 48*a* conveys a pressure change within the exhaust duct 50 indicative of an exhaust rate greater than or equal to about 300 CFM. As a result, the make-up air system 10 is not activated at times when it is not necessary to reduce or eliminate negative pressure. In other embodiments, the switch module 48*b* can activate the make-up air system 10 when the probe 48*a* conveys pressure changes within the exhaust duct 50 indicative of other flow rates (e.g., less than about 300 CFM).

Figure 7D:
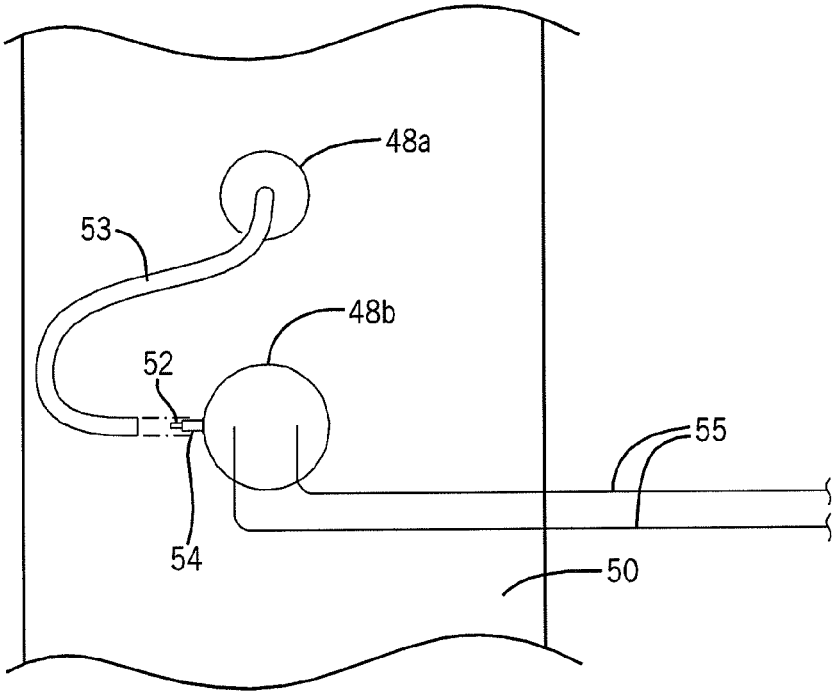
FIG. 7D is a perspective view of a pin and switch module arrangement according to one embodiment of the invention.
Figure 7E:
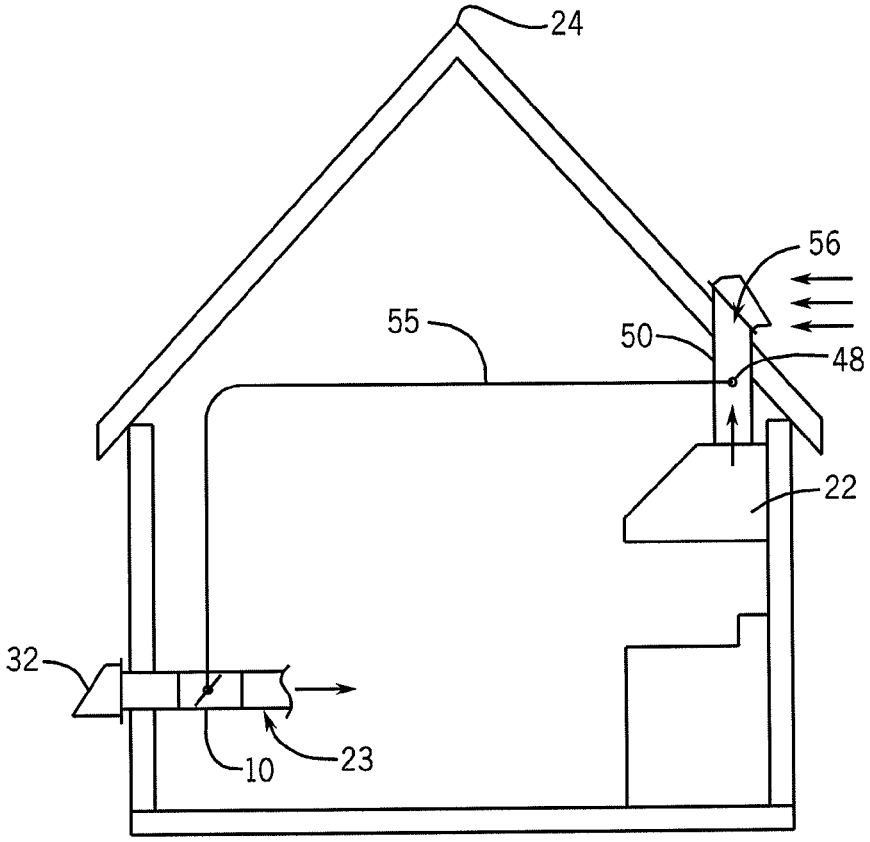
FIG. 7E is a diagram of a make-up air system and pressure switch installed in a structure according to one embodiment of the invention.

In some embodiments, the switch 48 can comprise other configurations to ensure activation of the make-up air system 10 at appropriate times. As shown in FIG. 7D, in some embodiments, one or more pins 52 can be disposed in the inlet 54 of the switch module 48*b*. For example, in some embodiments, the pin 52 can comprise a conventional orifice pin 52, in other embodiments, the pin 52 can comprise other types of pins 52. In some embodiments, by at least partially disposing the pin 52 within the inlet 54, the pin 52 can at least partially dampen the response of the module 48*b* to changes in pressure within the exhaust duct 50. As previously mentioned, the exhaust duct 50 can fluidly connect the exhaust device 22 to the outside environment. Although the exhaust duct 50 can comprise a cap 32 to reduce or prevent an influx of some unwanted materials (e.g., precipitation, debris, etc.), the cap 32 cannot prevent entry of all unwanted phenomena. For example, wind can pass across the cap 32 and an outlet 56 of the exhaust duct 50 and can at least partially enter the exhaust duct 50, which can at least partially impact pressure levels within the duct 50, as shown in FIG. 7E. In some embodiments functioning without one or more pins 52, depending on their magnitude, the changes in pressure within the exhaust duct 50 can cause the switch module 48*b* to activate the make-up air system 10 under the mistaken analysis (e.g., the wind creates a "false positive" exhaust event) that air is being exhausted from the structure 24. In some embodiments, the pin 52 can function to "dampen" the switch module 48*b* to changes in pressure (e.g., make the switch module 48*b* less sensitive to changes in pressure within the exhaust duct 50). As a result, in some embodiments, by disposing one or more pins 52 within the inlet 54 of the switch module 48*b*, the make-up air system 10 can be triggered when pressure within the exhaust duct 50 reaches a level sufficient to overcome the dampening effect of the pins 52 and can remain substantially inactive when pressure levels are not sufficient to reach levels of producing negative pressure. Other orifice metering or throttling devices can also be used.

Figure 7F:
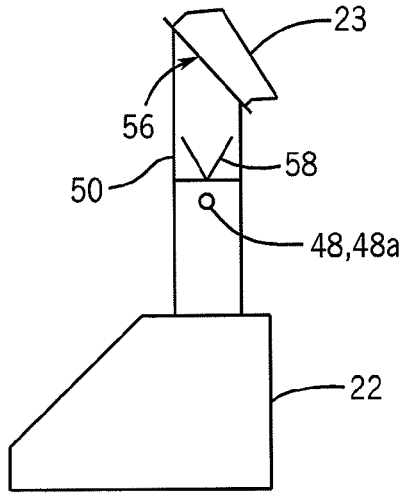
FIG. 7F is a diagram of a pressure switch retroactively coupled to an exhaust device according to one embodiment of the invention.

As shown in FIG. 7F, in some embodiments, the switch 48 can comprise other configurations to ensure activation of the make-up air system 10 at appropriate times. In some embodiments, the exhaust device 22 can comprise one or more damper flaps 58 operatively coupled to the device 22 substantially adjacent to an outlet (not shown) of the device 22. For example, the damper flap 58 can be coupled to the exhaust device 22 and/or the exhaust duct 50 so that the flap 58 moves in response to the exhaust device 22 moving air (e.g., air flow through the exhaust duct 50 causes the flap 58 to move from a closed positioned to an open position). In some embodiments, by disposing a portion of the switch 48 (e.g., the probe 48*a*) between the damper flap 58 and the exhaust device 22, at least a portion of the wind or other natural phenomenon that could cause the switch 48 to register a pressure change could go undetected by the switch 48. For example, by disposing the probe 48*a* in the exhaust duct 50 so that the damper flap 58 separates the exhaust duct outlet 56 and the probe 48*a*, the probe 48*a* can be at least partially insulated from the natural phenomena that could cause unnecessary activation of the system 10.

Figure 7G:
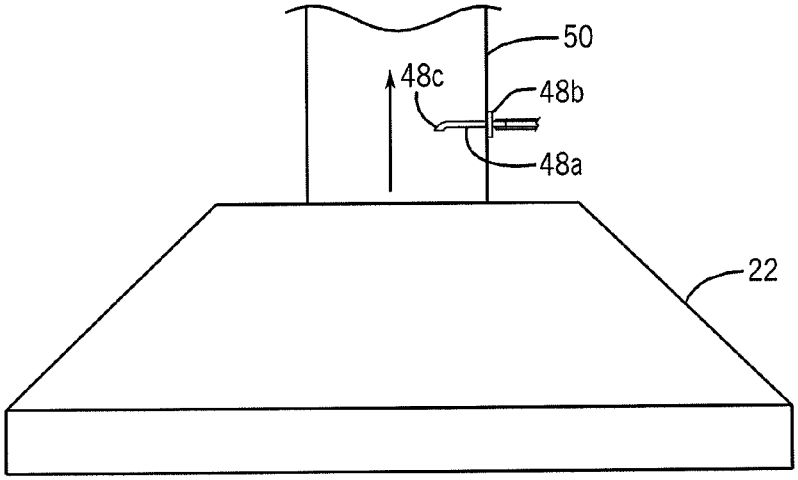
FIG. 7G is a diagram of portions of a pressure switch coupled to an exhaust duct according to one embodiment of the invention.
Figure 7H:
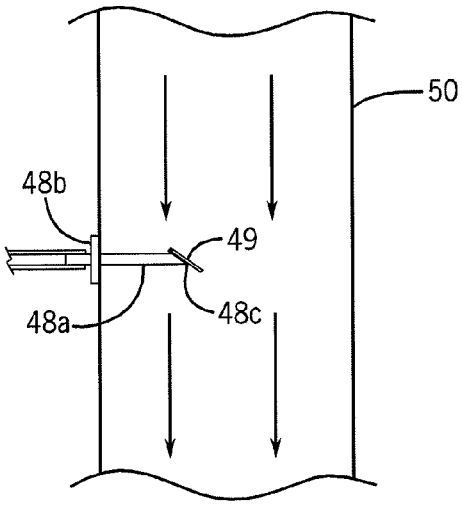
FIG. 7H is a diagram of a probe according to one embodiment of the invention.
Figure 7I:
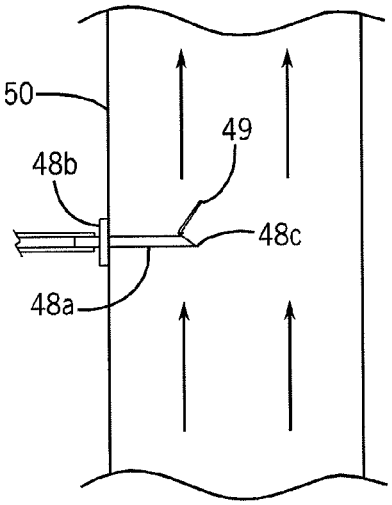
FIG. 7I is a diagram of a probe according to one embodiment of the invention.

As shown in FIGS. 7G-7I, in some embodiments, the probe 48*a* can comprise alternative configurations to ensure activation of the make-up air system 10 at appropriate times. For example, as shown in FIG. 7G, some conventional probes 48*a* can comprise an end region 48*c* that is configured and arranged to detect fluid flow. In some embodiments, the end region 48*c* can be angled, bent, hooked, or otherwise configured so that at least a portion of the passing fluid (e.g., air or other exhaust) can be received within the probe 48*a* and transported to the module 48*b*, as shown in FIG. 7G. Although this configuration can be useful in detecting pressure within the exhaust duct 50, it can be susceptible to inappropriately triggering the make-up air system 10 because even air flow through the duct 50 caused by wind would be detected by the probe 48*a*. As shown in FIGS. 7H and 7I, in some embodiments, the probe 48*a* can comprise a configuration to at least partially reduce the risk of unnecessary activation of the make-up air system 10.

As shown in FIGS. 7H and 7I, in some embodiments, the end region 48*c* can comprise an angled configuration and a seal 49 can be operatively coupled to the end region 48*c*. As shown in FIGS. 7H and 7I, the seal 49 can be pivotably coupled to the probe 48*a* so that air or other fluids can only be detected by the probe 48*a* and module 48*b* from one general direction. For example, the seal 49 can be coupled to the probe 48*a* at the end region 48*c* so that when air or other fluids come down the exhaust duct 50 (e.g., caused by wind or other natural phenomena), the force of the fluids contacting the seal 49 can cause the seal 49 to engage the end region 48*c* so that no pressure change registers at the module 48*b*. Moreover, as shown in FIG. 7I, when air or other fluids pass from the exhaust device 22 into the exhaust duct 50, the force of these fluids moving outward (i.e., away from the exhaust device 22 toward the exhaust duct outlet 56) can cause the seal 49 to move away from the end region 48*c* so that the probe 48*a* and module 48*b* can sense any changes in pressure within the exhaust duct 50. As a result of the seal 49 being coupled to the probe 48*a*, the risk of unnecessary activation of the make-up air system 10 can be at least partially reduced.

Figure 8:
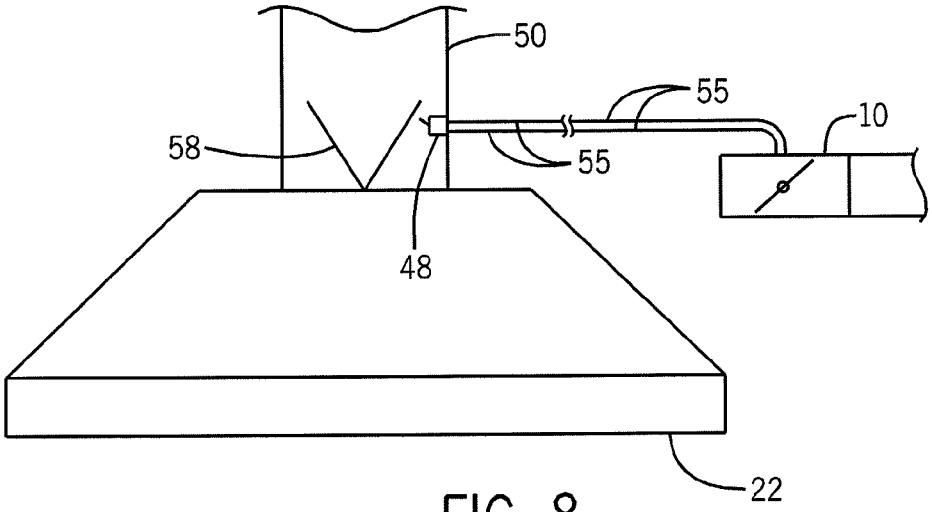
FIG. 8 is a diagram of a mechanical switch retroactively coupled to an exhaust device according to one embodiment of the invention.

In some embodiments, the switch 48 can comprise other configurations. As shown in FIG. 8, in some embodiments, the switch 48 can comprise a mechanical switch 48, such as a conventional limit switch 48. In some embodiments, the mechanical switch 48 can be coupled to the wall of the exhaust duct 50 so that at least a portion of the mechanical switch 48 is in fluid communication with the interior of the exhaust duct 50. In some embodiments, as a result of the damper flap 58 moving in response to air flow through the exhaust duct 50, the damper flap 58 can contact the mechanical switch 48 (e.g., cause the switch to close) to activate the make-up air system 10. In some embodiments, the mechanical switch 48 can be electrically connected to the motor 18 in a manner substantially similar to some of the previously mentioned embodiments. For example, the mechanical switch 48 can be coupled to the system 10 via electrical lines 55 that can carry a current to the motor 18 to move the damper 14 upon closing of the mechanical switch 48 by the damper flap 58. As previously mentioned, in some embodiments, the mechanical switch 48 be wirelessly connected to the make-up air system 10 (e.g., via radio-frequency transmission) to provide a signal to activate the motor 18. Accordingly, in some embodiments, movement of the damper flap 58 can, at least partially, correspond to increased exhaust through the exhaust duct 50 and can contact the mechanical switch 48 to function as a signal to activate the make-up air system 10, allowing ingress of air from the outside environment. Moreover, in some embodiments, deactivation of the exhaust device 22 can result in the damper flap 58 returning to a substantially closed position, which can result in an opening of the mechanical switch 48 to cease current flow to the make-up air system 10. As a result, material volumes of air or other fluids from the outside environment can cease to enter the structure 24 upon a deactivation of the exhaust device 22.

Figure 9:
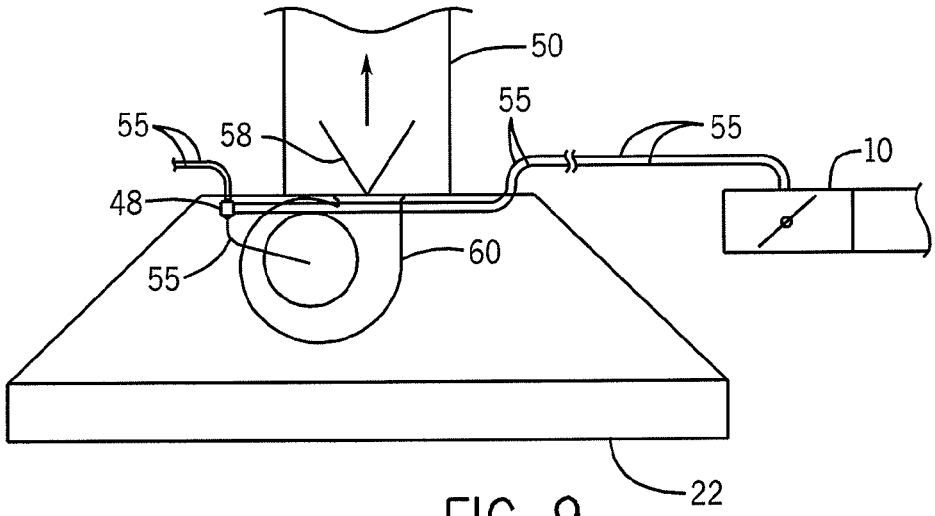
FIG. 9 is a diagram of an optical switch retroactively coupled to an exhaust device according to one embodiment of the invention.

In some embodiments, the switch 48 can comprise other configurations. In some embodiments, the switch 48 can comprise an optical switch 48. For example, the optical switch 48 can be configured and arranged to employ infrared sensors, lasers, etc. As shown in FIG. 9, in some embodiments, the optical switch 48 can be positioned within the exhaust duct 50 and at least partially directed toward the damper flap 58. In some embodiments, the optical switch 48 can be configured and arranged to detect movement of the damper flap 58 (e.g., in response to activation of the exhaust device 22) and activate the make-up air damper system 10 in response to flap 58 movement. As previously mentioned, movement of the damper flap 58 can be indicative of air movement out the structure 24 via the exhaust duct 50. In response to this signal, the optical switch 48 can provide a signal to the motor 18 to move the damper 14 (e.g., via electrical lines 55, wireless technologies, etc.) to enable an influx of air or other fluids from the outside environment to reduce or eliminate negative pressure. Moreover, in some embodiments, deactivation of the exhaust device 22 can result in the damper flap 58 returning to a substantially closed position, which can be detected by the optical switch 48 and can lead to cessation of current flow to the make-up air system 10. As a result, air or other fluids from the outside environment can cease to enter the structure 24 upon a deactivation of the exhaust device 22.

Figure 10:
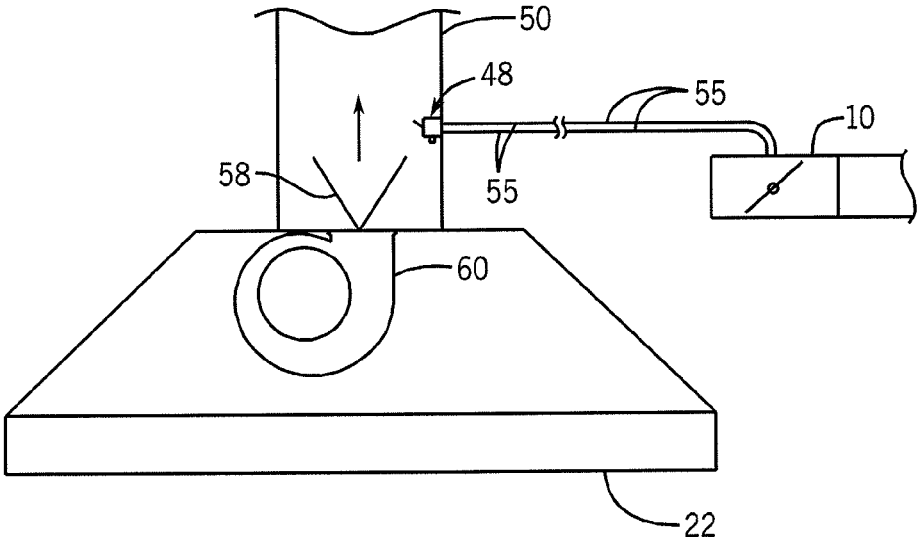
FIG. 10 is a diagram of a current-sensing switch retroactively coupled to an exhaust device according to one embodiment of the invention.

As shown in FIG. 10, in some embodiments, the switch 48 can comprise a current-sensing switch 48. In some embodiments, the current-sensing switch 48 can be in communication with a motor 60 of the exhaust device 22. For example, the motor 60 of the exhaust device 22 can provide the driving force to move air and other fluids out of the structure 24 via the exhaust duct 50. In some embodiments, the motor 60 can receive current from the electrical network of the structure 24 to drive air and other fluids out of the structure 24. As shown in FIG. 10, in some embodiments, the current-sensing switch 48 can be coupled to the motor 60 and/or the electrical lines 55 leading from the electrical network of the structure 24 to the motor 60. As a result of this positioning, the current-sensing switch 48 can close when the motor 60 receives current from the electrical network of the structure 24 to begin exhausting air and other fluids from the structure 24. In some embodiments, upon closing, the current-sensing switch 48 can provide current to the motor 18 to the move the damper 14 to allow an influx of air or other fluids from the outside environment to reduce or eliminate negative pressure. Similar to some other embodiments, the current-sensing switch 48 can also wirelessly communicate (e.g., via radio-frequency transmission) with the make-up air system 10 in addition to, or lieu of, the wired connection. Moreover, in some embodiments, deactivation of the exhaust device 22 can result in the little to no current flowing to the motor 60, which can result in an opening of the current-sensing switch 48 to cease current flow to the make-up air system 10. As a result, material volumes of air or other fluids from the outside environment can cease to enter the structure 24 upon a deactivation of the exhaust device 22.

Figure 11:
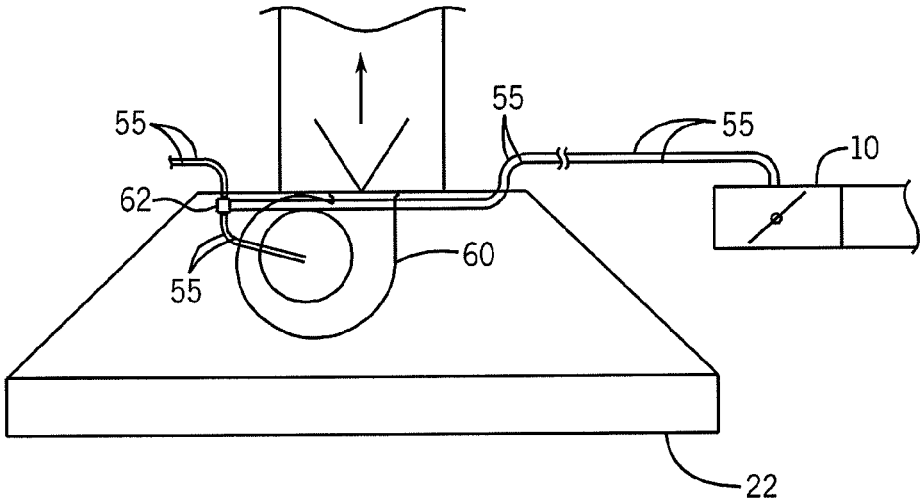
FIG. 11 is a diagram of a jumper retroactively coupled to an exhaust device according to one embodiment of the invention.

In some embodiments, in addition to, or in lieu of, the switch 48, the make-up air system 10 can be in communication with one or more jumpers 62. As shown in FIG. 11, in some embodiments, one or more of the electrical lines 55 can be electrically coupled to the jumper 62 so that some or all of the current entering the motor 60 of the exhaust device 22 passes through the jumper 62. For example, as shown in FIG. 11, at least one of the electrical lines 55 from the electrical network of the structure 24 can be connected to the jumper 62 and the jumper 62 can be electrically connected to the motor 60 and the make-up air system 10. As a result of current passing from the jumper 62 to the motor 60, the exhaust device 22 can begin exhausting air or other fluids from the structure 22, which can, as previously mentioned, create negative pressure. Moreover, in some embodiments, the jumper 62 can comprise a dry-contact relay that can enable current to flow from the jumper 62 to the motor 18 to move the damper 14 (e.g., via one or more electrical lines 55) to allow an influx of air from the outside environment to reduce or eliminate negative pressure. Similar to some other embodiments, the jumper 62 can also wirelessly communicate (e.g., via radio-frequency transmission) with the make-up air system 10 in addition to, or lieu of, the wired connection. Moreover, in some embodiments, deactivation of the exhaust device 22 can result in the little to no current flowing to the motor 60, which can result in an opening of the dry-circuit relay coupled to the jumper 62 which will then cease current flow to the make-up air system 10. As a result, material volumes of air or other fluids from the outside environment can cease to enter the structure 24 upon a deactivation of the exhaust device 22.

Figure 12:
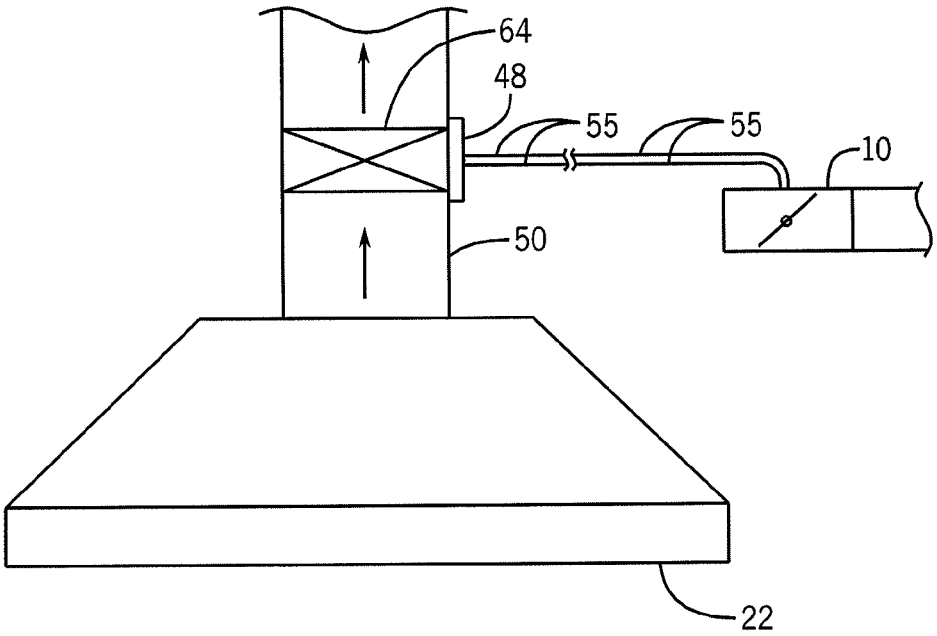
FIG. 12 is a diagram of a flow meter and a switch coupled to an exhaust device according to one embodiment of the invention.

In some embodiments, the switch 48 can be coupled to a flow meter 64. In some embodiments, the flow meter 64 can comprise a conventional vane anemometer, and in other embodiments, the flow meter 64 can comprise other structures that are configured and arranged to measure the rate of air moving through the exhaust duct 50. For example, in some embodiments, the switch 48 (e.g., the switch module 48*b*) can be coupled to the outside of the exhaust duct 50 and the flow meter 64 can be disposed inside of the exhaust duct 50, as shown in FIG. 12. In some embodiments, as the exhaust device 22 circulates air or other fluids outside of the structure 24 via the exhaust duct 50, the flow meter 64 can measure a rate of fluid flow through the exhaust duct 50. In some embodiments, the flow meter 64 can be coupled to the switch 48 so that the flow rate of fluid flow through the exhaust duct 50 can be relayed from the meter 64 to the switch 48. The switch 48 can be configured and arranged to process the data from the flow meter 64 to determine the fluid flow rate. For example, the switch 48 can be preprogrammed with a cross-sectional area of the exhaust duct 50 and the flow meter 64 can supply a velocity of the air or other fluids passing through and/or adjacent to the flow meter 64. Accordingly, the switch 48 can multiply the velocity by the cross-sectional area of the exhaust duct 50 to arrive at the air flow rate.

In some embodiments, the switch 48 can be configured and arranged to trigger the make-up air system 10 when the air flow rate reaches a pre-determined threshold. For example, in some embodiments, the switch 48 can be configured to activate the make-up air system 10 when the exhaust flow rate reaches about 300 CFM or greater. In other embodiments, the pre-determined threshold can comprise other values (e.g., 100 CFM, 400 CFM, 500 CFM, etc.) to meet user needs. When the air flow rate reaches the pre-determined threshold, similar to some other embodiments, the switch 48 can close to circulate a current to the motor 18 to move the damper 14 to enable an influx of air from the outside environment to reduce or eliminate negative pressure.

In some embodiments, the flow meter 64 can comprise alternate configurations. For example, in some embodiments, the flow meter 64 can comprise a flow wheel (not shown), including a dry-contact relay, which can be disposed within the exhaust duct 50. The flow wheel can be moved (e.g., rotated) when the exhaust device 22 moves air or other fluids through the exhaust duct 50. As a result of the movement of the flow wheel, the dry-contact relay can close, which can lead to current flowing to the make-up air system 10 and result in air or other fluids entering the structure 24 via the system 10.

As previously mentioned, some or all of the previous embodiments can include the make-up air system 10 coupled to the apparatus providing an activation signal and/or a deactivation signal via electrical lines 55 or wireless communication capabilities, such as radio-frequency transmissions. For example, in some embodiments, the switch 48 can comprise a radio-frequency transmitter (not shown) and the make-up air system 10 can comprise a radio-frequency receiver so that some or all of the activation/deactivation signals can be wirelessly transmitted. As previously mentioned, the make-up air system 10 can also receive activation/deactivation signals via Insteon™ and/or LinkLogic™ protocols.

In some embodiments, the apparatuses, devices, or structures that provide activation signals to the make-up air system 10 (e.g., the switch 48) can be installed in multiple configurations. For example, as previously mentioned, in some embodiments, the switch 48 and accompanying elements can be coupled to an existing exhaust duct 50 or other portions of the duct system 23. In other embodiments, the switch 48 and accompanying elements can be manufactured so that they are substantially or completely integral with a section of an exhaust duct 50. As a result, an installer can remove a portion of an existing exhaust duct 50 and install the replacement exhaust duct portion that includes the switch 48 and accompanying elements in lieu of installing the switch 48 on an existing duct 50.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A system capable of reducing negative pressure within a space receiving air through an intake duct and exhausting air through an exhaust duct coupled to an exhaust device configured to exhaust air from the space, the system comprising:

a make-up air system is configured to be installed within a structure, the make-up air system being operatively connected to the intake duct to selectively permit supplemental air into the intake duct; and a pressure switch configured to sense a pressure change within the exhaust duct upstream of a dampening feature of the exhaust duct reducing pressure changes originating downstream, wherein the pressure switch is configured to be retroactively coupled to one of the exhaust duct and the exhaust device;

wherein the pressure switch is configured to communicate an activation signal to the make-up air system to permit supplemental air into the intake duct when a pressure change within the exhaust duct indicative of an exhaust rate exceeding a pre-determined threshold is detected, wherein the pressure switch is configured to communicate a deactivation signal to the make-up air system to restrict supplemental air into the intake duct when a pressure change within the exhaust duct indicative of an exhaust rate below a pre-determined threshold is detected.

2. The system of claim 1, wherein the pressure switch comprises at least one probe coupled to at least one switch module, and wherein the at least one probe is configured and arranged to be at least partially disposed within the exhaust duct and the at least one switch module is configured and arranged to be coupled to an outside of the exhaust duct.

3. The system of claim 2, where in the switch module comprises an inlet and at least one orifice pin is disposed within the inlet.

4. The system of claim 2 and further comprising a seal operatively coupled to a portion of the probe.

5. The system of claim 1 and further comprising at least one electrical line configured and arranged to connect the pressure switch and a motor of the make-up air system and to carry a current between the pressure switch and the motor.

6. The system of claim 1, wherein the make-up air system and the pressure switch are configured and arranged to wirelessly communicate.

7. The system of claim 1, wherein the structure comprises at least one wall and the make-up air system is configured and arranged to be at least partially disposed through the wall to fluid couple an environment on an outside of the wall and an environment on an inside of the wall upon receiving an activation signal from the pressure switch.

8. A system capable of reducing negative pressure within an internal environment of a structure receiving air through an intake duct and exhaust air from the internal environment through an exhaust duct coupled to an exhaust device configured to exhaust air from the internal environment, the system comprising:

a make-up air system comprising a duct housing and a damper operatively coupled to a motor, the damper being movable between a first position and a second position, wherein the make-up air system is capable of being installed through a portion of the structure to fluidly connect an external environment of the structure with the intake duct when the damper is substantially disposed in the second position to permit air to enter the intake duct; and a switch configured to be retroactively coupled to one of the exhaust duct and the exhaust device upstream of a dampening feature of the exhaust duet reducing pressure changes originating downstream; the switch having a sensor is configured to communicate an activation signal to the make-up air system to position the damper in the second position when a pressure change indicative of an exhaust rate exceeding a pre-determined threshold is detected and a deactivation signal to the make-up air system to position the damper in the first position when a pressure change indicative of an exhaust rate below a pre-determined threshold is detected.

9. The system of claim 1, wherein the dampening feature includes at least one of an exhaust duct segment having a predetermined minimum length, a non-linear duct segment, an exhaust duct cap, an orifice metering device, a throttling device, a damper device, or combinations thereof.

10. The system of claim 8, wherein the exhaust device comprises a damper flap.

11. The system of claim 10, wherein the switch comprises a mechanical switch capable of being at least partially disposed within the exhaust duct so that the damper flap contacts the mechanical switch when the exhaust device is in an activated state.

12. The system of claim 10, wherein the switch comprises an optical switch capable of being at least partially disposed within the exhaust duct to sense movement of the damper flap when the exhaust device is in an activated state.

13. The system of claim 8, wherein the switch comprises a current-sensing switch.

14. The system of claim 13, wherein the exhaust device comprises a motor capable of being coupled to one or more electrical lines of the structure, and wherein the current-sensing switch is capable of being coupled to at least one of the motor and the electrical lines to sense a current flow to the motor.

15. The system of claim 8 and further comprising one or more flow meters in communication with the switch.

16. The system of claim 15, wherein the flow meter is configured and arranged to be at least partially disposed within the exhaust duct to detect a rate of fluid flow within the exhaust duct.

17. The system of claim 16, wherein the switch is configured and arranged to activate the make-up air system to move the damper to the second position when the rate of fluid flow reaches a pre-determined threshold.

18. The system of claim 8, further comprising at least one electrical line configured and arranged to connect the switch and the motor.

19. The system of claim 8, wherein the make-up air system and the switch are configured and arranged to wirelessly communicate.

20. The system of claim 8, wherein the dampening feature includes at least one of an exhaust duct segment having a predetermined minimum length, a non-linear duct segment, an exhaust duct cap, an orifice metering device, a throttling device, a damper device, or combination s thereof.

21. A method of assembling a system to reduce negative pressure within a space receiving air through an intake duct and exhausting air through an exhaust duct coupled to an exhaust device configured to exhaust air from the space, the method comprising:

providing a make-up air system being configured and arranged to be installed within a structure, the make-up air system being operatively connected to the intake duct and to selectively permit supplemental air into the intake duct; and providing an apparatus having a sensor for monitoring the exhaust duct upstream of a dampening feature of the exhaust duct reducing pressure changes originating downstream and being configured and arranged to communicate at least one of an activation signal and a deactivation signal to the make-up air system in response to detected pressure indicative of an exhaust flow exceeding a predetermined threshold;

wherein the apparatus is configured and arranged to be retroactively coupled to one of an exhaust duct and an exhaust device.

22. The method of claim 21, wherein the apparatus comprises one or more of a pressure switch, a mechanical switch, a current-sensing switch, an optical switch, a jumper, and a flow meter coupled to a switch.

23. The method of claim 21, wherein the dampening feature includes at least one of an exhaust duct segment having a predetermined minimum length, a non-linear duct segment, an exhaust duct cap, an orifice metering device, a throttling device, a damper device, or combinations thereof.

* * * * *